US008264305B2

(12) United States Patent
Toujo

(10) Patent No.: US 8,264,305 B2
(45) Date of Patent: Sep. 11, 2012

(54) RESONATOR, SUBSTRATE HAVING THE SAME, AND METHOD OF GENERATING RESONANCE

(75) Inventor: Atsushi Toujo, Yasu (JP)

(73) Assignee: Murata Manufacturing Co., Ltd., Nagaokakyo-Shi, Kyoto-fu (JP)

( * ) Notice: Subject to any disclaimer, the term of this patent is extended or adjusted under 35 U.S.C. 154(b) by 36 days.

(21) Appl. No.: 12/815,668

(22) Filed: Jun. 15, 2010

(65) Prior Publication Data

US 2010/0259343 A1 Oct. 14, 2010

Related U.S. Application Data

(63) Continuation of application No. PCT/JP2008/070407, filed on Nov. 10, 2008.

(30) Foreign Application Priority Data

Dec. 21, 2007 (JP) ..... 2007-330512

(51) Int. Cl.
*H01P 7/08* (2006.01)
*H01P 1/203* (2006.01)

(52) U.S. Cl. ..... 333/219; 333/204

(58) Field of Classification Search ..... 333/175, 333/176, 185, 202–205, 219, 235
See application file for complete search history.

(56) References Cited

U.S. PATENT DOCUMENTS 5,892,415 A * 4/1999 Okamura ..... 333/175
6,414,568 B1 * 7/2002 Matsumura et al. ..... 333/185
2008/0165079 A1 7/2008 Smith et al.

FOREIGN PATENT DOCUMENTS

JP 2005-033579 A 2/2005

OTHER PUBLICATIONS

"Left-handed metamaterial"; Nikkei Electronics, Nikkei Business Publications, Inc., Jan. 2, 2006, p. 75-81 (Figure B-2 (a) p. 80).
PCT/JP2008/070407 International Search Report dated Jan. 30, 2009.
PCT/JP2008/070407 Written Opinion dated Jan. 30, 2009.
Neethling et al. "A Composite Right/Left Handed Transmission Line Implementing Quasi-Exponential Inductive Stubs" Proceedings of the 36th European Microwave Conference, Horizon House Publications, Ltd. Sep. 2009, pp. 431-434.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

A resonator having respective electrode planes of first and second internal electrodes disposed so as to be substantially parallel to a line of magnetic force of a magnetic field. In the resonator, respective electrode planes of first and second external electrodes are disposed so as to be substantially parallel to the line of magnetic force of the magnetic field in planes different from the electrode planes of the first and second internal electrodes.

17 Claims, 8 Drawing Sheets

RESONATOR, SUBSTRATE HAVING THE SAME, AND METHOD OF GENERATING RESONANCE

CROSS REFERENCE TO RELATED APPLICATIONS

The present application is a continuation of International Application No. PCT/JP2008/070407, filed Nov. 10, 2008, which claims priority to Japanese Patent Application No. JP2007-330512, filed Dec. 21, 2007, the entire contents of each of these applications being incorporated herein by reference in their entirety.

FIELD OF THE INVENTION

The present invention relates to a resonator capable of generating resonance by being made close to a conductor in which current flows, a substrate including the same, and a method of generating resonance, and more particularly relates to a configuration making negative magnetic permeability appear and using it.

BACKGROUND OF THE INVENTION

In recent years, attention is being paid to a device called a metamaterial. The metamaterial is an artificial substance having an electromagnetic or optical characteristic which is not provided in substances existing in the natural world. Representative characteristics of such a metamaterial include negative magnetic permeability ($\mu<0$), negative dielectric constant ($\in<0$), or negative refractive index (in a case where both of the magnetic permeability and the dielectric constant are negative). A region satisfying $\mu<0$ and $\in>0$ or a region satisfying $\mu>0$ and $\in<0$ is also called an "evanescent solution region", and a region satisfying $\mu<0$ and $\in<0$ is also called a "left-handed system region".

FIG. 10 is a four-quadrant diagram showing characteristics which appear with respect to waves incident on a medium by signs of the magnetic permeability $\mu$ and the dielectric constant $\in$. Most of substances existing in the natural world correspond to right-handed media positioned in the first quadrant shown in FIG. 10. A wave incident on this medium is refracted only by a refractive index determined by the magnetic permeability and the dielectric constant and then propagates in the incident direction. In contrast, in the second and fourth quadrants (evanescent solution regions) shown in FIG. 10, the incident wave cannot propagate. In the third quadrant (left-handed region) shown in FIG. 10, the refractive index is negative, so that a wave incident on this medium propagates in a direction opposite to the incident direction.

As an example of realizing such a metamaterial, a split ring resonator (SRR) for microwaves is disclosed in "Left-handed metamaterial", Nikkei Electronics January 2, Nikkei Business Publications, Inc., Jan. 2, 2006, p. 75-81". In the split ring resonator, unit cells each made by two large and small ring patterns in which a part of the circumference is notched are periodically disposed. In the split ring resonator, resonance occurs in a specific frequency region, and $\mu<0$ appears. By disposing the split ring resonator and a metal rod ($\in<0$) close to each other, $\mu<0$ and $\in<0$ appear, and a left-handed medium can be realized.

By making negative magnetic permeability appear, unnecessary electromagnetic waves emitted from an electronic device or the like can be suppressed. More specifically, when a magnetic flux enters a medium in which negative magnetic permeability appears, unnecessary electromagnetic waves emitted from an electronic device or the like can be reflected or suppressed.

Non-patent document 1: "Left-handed metamaterial", Nikkei Electronics January 2, Nikkei Business Publications, Inc., Jan. 2, 2006, p. 75-81

However, in the split ring resonator as disclosed in the above prior art document, a conductor is formed in a plane, so that capacitance which is large enough cannot be obtained. There is a problem such that, to realize desired characteristics, the size becomes relatively large.

SUMMARY OF THE INVENTION

The present invention has been achieved to solve the problems and an object of the invention is to provide a smaller resonator in which negative magnetic permeability can be made appear by resonance generated by receiving electromagnetic waves from the outside.

According to an aspect of the present invention, there is provided a resonator disposed close to a conductor in which current including a predetermined frequency component flows to generate resonance in response to an electromagnetic wave generated by the current. The resonator includes: a plurality of pairs of electrodes each made of first and second electrodes facing each other via an insulator; a third electrode electrically connected to each of the first electrodes; and a fourth electrode electrically connected to each of the second electrodes. The resonator can be disposed so that respective electrode planes of the first and second electrodes are substantially parallel to a line of magnetic force which is generated when current flows in the conductor, and respective electrode planes of the third and fourth electrodes are substantially parallel to the line of magnetic force in planes different from the respective electrode planes of the first and second electrodes.

According to another aspect of the present invention, there is provided a resonator disposed close to a conductor in which current including a predetermined frequency component flows to generate resonance in response to an electromagnetic wave generated by the current. The resonator includes: a pair of external electrodes made of two external electrodes formed to face each other in parallel; and an internal electrode group made by a plurality of first internal electrodes electrically connected to one of the pair of external electrodes and a plurality of second internal electrodes electrically connected to another one of the pair of eternal electrodes. Each electrode plane of the internal electrode group is formed perpendicular to an electrode plane of the external electrode. Each electrode plane of the external electrode pair is formed parallel to a plane perpendicular to a propagation direction of current flowing in the conductor. An electric circulating path is formed including a first capacitance generated between one of the first internal electrodes and the second internal electrode adjacent to the first internal electrode, a second capacitance generated between another one of the first internal electrodes and the second internal electrode adjacent to the first internal electrode, and the pair of external electrodes.

Preferably, in a connection plane between each of the electrodes of the internal electrode group and the external electrode, a width of the external electrode is smaller than a width of each of the electrodes of the internal electrode group.

According to further another aspect of the present invention, there is provided a resonator disposed close to a conductor in which current including a predetermined frequency component flows to generate resonance in response to an electromagnetic wave generated by the current. The resonator includes: a plurality of flat-plate electrodes disposed parallel to each other via an insulator; a first connection electrode electrically connected to an even-numbered flat-plate electrode in the plurality of flat-plate electrodes; and a second connection electrode electrically connected to an odd-numbered flat-plate electrode in the plurality of flat-plate electrodes. The resonator is disposed so that respective electrode planes of the first and second electrodes are substantially parallel to a line of magnetic force which is generated when current flows in the conductor, and respective electrode planes of the third and fourth electrodes are substantially parallel to the line of magnetic force in planes different from the respective electrode planes of the first and second electrodes.

Preferably, a strip-shaped conductor as the conductor is disposed in a position apart by a predetermined distance from an uppermost plane of the plurality of flat-plate electrodes, and a ground electrode is further provided in a position apart by a predetermined distance from a lowest plane of the plurality of flat-plate electrodes.

According to further another aspect of the present invention, there is provided a resonator disposed close to a conductor in which current including a predetermined frequency component flows to generate resonance in response to an electromagnetic wave generated by the current. The resonator includes: first and second comb-shaped electrodes each having a plurality of electrode planes parallel to one another. An uppermost electrode plane of the first comb-shaped electrode and that of the second comb-shaped electrode are formed so as to face each other in parallel at a predetermined interval and a lowermost electrode plane of the first comb-shaped electrode and that of the second comb-shaped electrode plane are formed so as to face each other in parallel at a predetermined interval. Respective electrode planes of the first and second comb-shaped electrodes can be disposed substantially parallel to a line of magnetic force which is generated when current flows in the conductor.

Preferably, a length of the resonator along the conductor is set to be shorter than ¼ of one wavelength corresponding to the predetermined frequency component.

A substrate according to further another aspect of the present invention includes a plurality of resonators described above. The substrate further includes a strip-shaped conductor in which current containing a predetermined frequency component flows, and the plurality of resonators are disposed periodically along the strip-shaped conductor.

According to further another aspect of the present invention, there is provided a method of generating resonance with a predetermined frequency component in a current flowing in a conductor. The method of generating resonance includes the step of disposing a resonator close to the conductor. The resonator includes: a plurality of pairs of electrodes each made of first and second electrodes facing each other via an insulator; a third electrode electrically connected to each of the first electrodes; and a fourth electrode electrically connected to each of the second electrodes. The disposing step includes the steps of: disposing respective electrode planes of the first and second electrodes so as to be substantially parallel to a line of magnetic force which is generated when current flows in the conductor; and disposing respective electrode planes of the third and fourth electrodes so as to be substantially parallel to the line of magnetic force in planes different from the respective electrode planes of the first and second electrodes.

According to the present invention, there can be realized a smaller resonator in which negative magnetic permeability can be made appear by resonance generated in response to electromagnetic waves from the outside.

DESCRIPTION OF REFERENCE SYMBOLS

Figure 1:
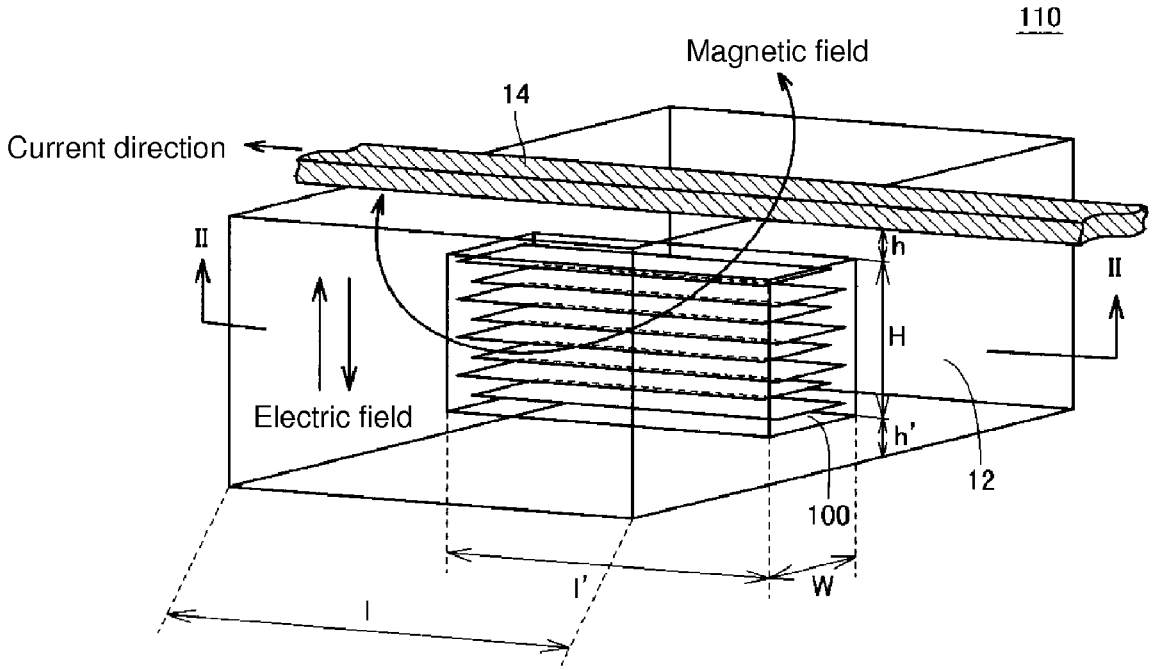
FIG. 1 is a schematic external view of a resonator-built-in substrate according to a first embodiment of the present invention.

2, 2# first external electrode
3, 3# second external electrode
4 first internal electrode
4*a*, 4*b*, 5*a*, 5*b* electrode
5 second internal electrode
6 spacer
12 exterior part
14 strip-shaped conductor (conductor)
16 ground electrode
100, 200 resonator
110, 210 resonator-built-in substrate
310, 410 substrate
C1, C2 capacitance
L1 to L6 inductance

DETAILED DESCRIPTION OF THE INVENTION

Embodiments of the present invention will be described in detail with reference to the drawings. The same reference symbols are designated to the same or corresponding parts in the drawings and description thereof will not be repeated.

Outline

Each of the embodiments according to the present invention provides a resonator classified as a metamaterial and a substrate including a plurality of resonators described above. Concretely, in the resonator and the substrate, a resonance circuit is formed, which uses a device (representatively, a multilayer capacitor) including a plurality of electrodes disposed apart from one another by predetermined intervals and is made mainly by capacitance generated between the electrodes. The resonance circuit is sensitive to a specific frequency component in an electromagnetic wave generated when alternate current flows in a conductor and, in response to the electromagnetic wave having the frequency component, can generate an electric resonance phenomenon. By the resonance phenomenon, negative magnetic permeability appears, and the electromagnetic wave emitted from the conductor can be reflected or suppressed.

To make the negative magnetic permeability as a function of a metamaterial appear, that is, to make resonance occur, the length in a current propagation direction of each resonator needs to be shorter than at least $\lambda/4$ of a wavelength $\lambda$ of the electromagnetic wave at a target frequency. Further, the length in the current propagation direction of each resonator is preferably $\lambda/20$ or less.

Each of the following first to fourth embodiments exemplifies a configuration of realizing a resonator or a substrate according to the present invention more easily by using a multilayer capacitor or the like formed by stacking a plurality of flat-plate electrodes via insulators (dielectrics).

FIRST EMBODIMENT

In the first embodiment of the present invention, there will be described a configuration of realizing a resonator using a general multilayer capacitor.

FIG. 1 is a schematic external view of a resonator-built-in substrate 110 according to the first embodiment of the invention.

Referring to FIG. 1, the resonator-built-in substrate 110 includes a resonator 100 and an exterior part 12 as a non-magnetic member for covering the periphery of the resonator 100. For the exterior part 12, a resin material such as Teflon (registered trademark) is suitable. When the resonator 100 is disposed close to a strip-shaped conductor 14 (hereinbelow, also simply described as "conductor 14") in which current containing a predetermined frequency component flows, the resonator 100 receives a specific frequency component (resonance frequency) in an electromagnetic wave generated by the current, and exhibits resonance. On the face opposite to the face in contact with the conductor 14, of the resonator 100, a ground electrode 16 (not shown) is disposed.

By the resonance in the resonator 100, a magnetic flux is generated from the inside of the resonator 100 to the outside. By an electric field induced by the magnetic flux thus generated, the electromagnetic wave generated by the current is disturbed. As a result, in the conductor 14, the flow of the alternating current of the resonance frequency component in the resonator 100 is disturbed, and the resonator-built-in substrate 110 functions as a kind of a band cutoff filter.

The resonator-built-in substrate 110 according to the present embodiment is a passive device which exhibits resonance only by an electromagnetic wave (particularly, magnetic flux) emitted from the conductor 14 without requiring electric energy from an external power source or the like. That is, the resonator 100 is not electrically connected to the strip-shaped conductor 14 or to the ground electrode 16 but is floated. By making such resonance occur, the resonator 100 makes negative magnetic permeability appear.

In order for the resonator 100 to make the negative magnetic permeability appear, that is, to exhibit the function of metamaterial, length "l" in the current propagation direction in the conductor 14 of the resonator 100 needs to be shorter than at least $\lambda/4$ of the wavelength $\lambda$ of the electromagnetic wave at the resonance frequency. Further, the length "l" of the resonator 100 is preferably $\lambda/20$ or less.

In the following, a case of using the multilayer capacitor having length l'=1.6 mm, width W=0.8 mm, and height H=0.8 mm and including internal electrodes of eight layers will be described as an example of the resonator 100. Distance "h" between the conductor 14 and the multilayer capacitor is assumed to be 0.2 mm, and distance h' between the multilayer capacitor and the ground is assumed to be 0.2 mm.

When it is assumed that $\lambda/4$=length l'=1.6 mm, $\lambda$ is equal to 6.4 mm which corresponds to, in air, frequency fmax=46.875 GHz. Therefore, when arranging the resonators 100 at intervals of $\lambda/4$ or less, the resultant can be used as a metamaterial in a gigahertz range. Naturally, the length "l" of the resonator can be properly designed according to a frequency domain to be applied.

Figure 2:
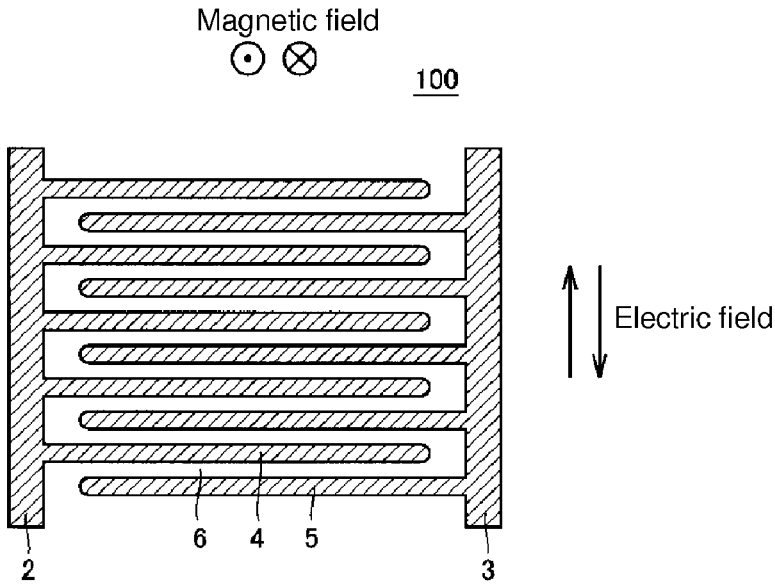
FIG. 2 is a cross section taken along line II-II shown in FIG. 1.

Next, the structure of the resonator 100 will be described with reference to FIGS. 1 and 2. FIG. 2 is a cross section taken along line II-II shown in FIG. 1.

Referring to FIG. 1, when current flows in the conductor 14, a magnetic field of alternating current is generated in the circumferential direction around the conductor 14 as a center. That is, the line of magnetic force of the magnetic field forms concentric circles with the conductor 14 as a center. Since potential is generated in the conductor 14 when the current flows in, an electric field of alternating current is generated between the conductor 14 and the ground electrode 16.

With reference to FIG. 2, the resonator 100 includes a plurality of first internal electrodes 4 and a plurality of second internal electrodes 5 facing each other via spacers 6 that are insulators each having high relative permeability. The plurality of first internal electrodes 4 are electrically connected to a first external electrode 2, and the plurality of second internal electrodes 5 are electrically connected to a second external electrode 3. In such a manner, in the resonator 100, the plurality of internal electrodes 4 and 5 each having a flat-plate shape are stacked alternately. Between the neighboring first and second internal electrodes 4 and 5, there is generated capacitance of which value is determined by the areas of the electrodes, the distance between the electrodes, the relative permeability of the spacer 6, and the like.

In particular, in the resonator-built-in substrate 110 according to the present embodiment, respective electrode planes of the first and second internal electrodes 4 and 5 constructing the multilayer capacitor are disposed so as to be substantially parallel to the line of magnetic force of the magnetic field. Simultaneously, the respective electrode planes of the first and second external electrodes 2 and 3 are disposed so as to be substantially parallel to the line of magnetic force of the magnetic field in planes different from the respective electrode planes of the first and second external electrodes 2 and 3. That is, as shown in FIG. 2, in a case where the line of magnetic force of the magnetic field generated by the current flowing in the conductor 14 is generated in the direction perpendicular to the plane of paper, the resonator 100 is disposed so that the electrode section longitudinal direction of the first and second internal electrodes 4 and 5 coincides with the lateral direction of the plane of paper, and the electrode section longitudinal direction of the first and second external electrodes 2 and 3 coincides with the vertical direction of the plane of paper.

Figure 3:
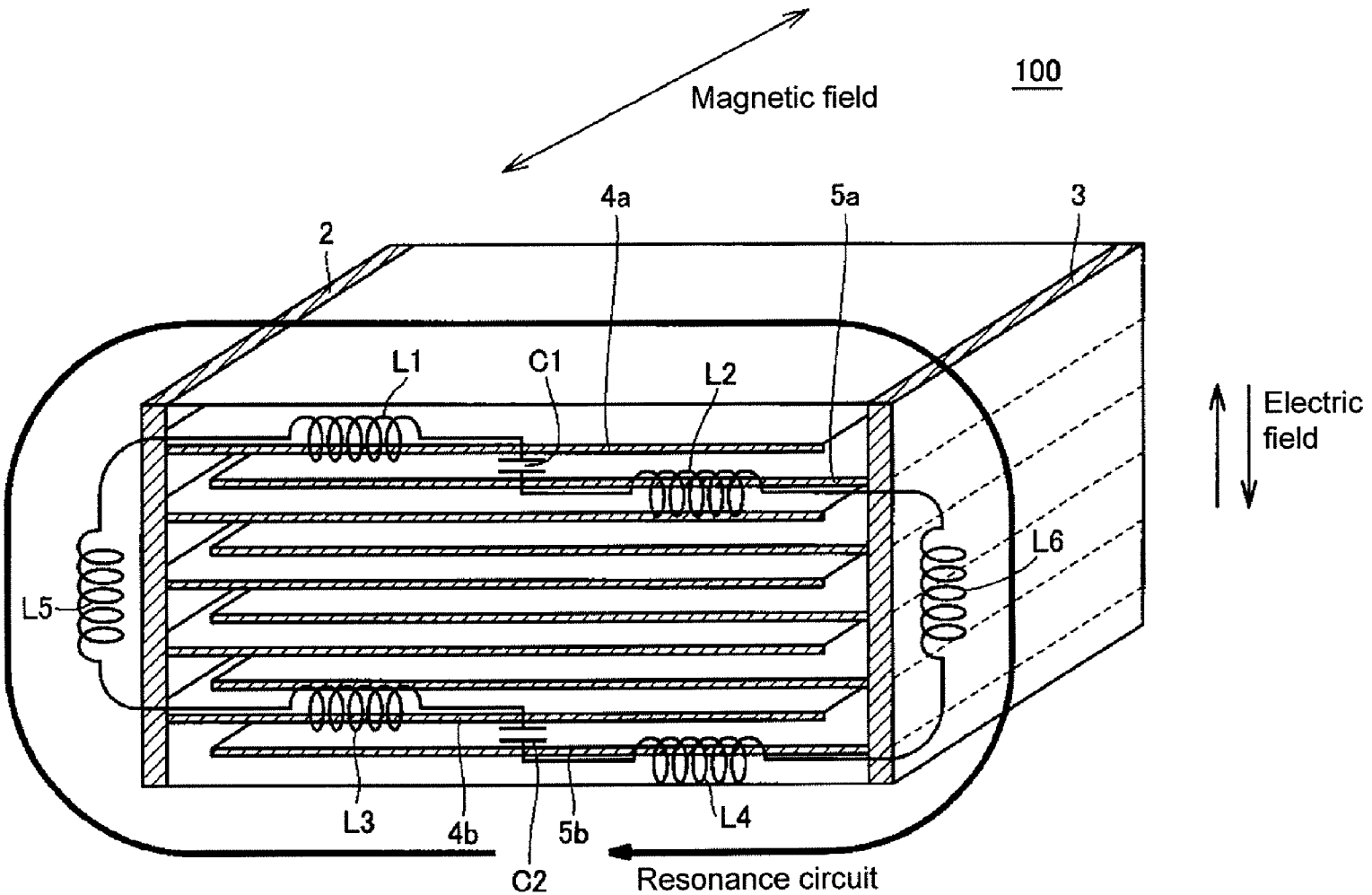
FIG. 3 is a diagram for explaining a resonance circuit formed by a resonator at a resonance frequency.

When the resonator 100 is disposed in the positional relation as shown in FIG. 2, a resonance circuit as shown in FIG. 3 is formed with respect to a predetermined frequency component. By the resonance circuit, negative magnetic permeability appears.

FIG. 3 is a diagram for explaining the resonance circuit formed by the resonator 100 at the resonance frequency.

With reference to FIG. 3, the first and second internal electrodes 4 and 5 and the first and second external electrodes 2 and 3, which are disposed so that the electrode planes are substantially parallel to the line of magnetic force of the magnetic field, operate as a coil (inductor) according to the length of the path.

In the resonator 100, an electrode 4*a* in the uppermost layer of the first internal electrode, the first external electrode 2, and an electrode 4*b* in the lowermost layer of the first internal electrode are electrically connected to one another, thereby forming a current path including them. Similarly, an electrode 5*a* in the uppermost layer of the second internal electrode, the second external electrode 3, and an electrode 5*b* in the lowermost layer of the second internal electrode are electrically connected to one another, thereby forming a current path including them. Via capacitance (C1) between the electrodes 4*a* and 5*a* and capacitance (C2) between the electrodes 4*b* and 5*b*, the both current paths are electrically connected to each other, and formed is a resonance circuit including the capacitances C1 and C2 and inductances L1 to L6 generated by the respective electrodes. Therefore, the resonator 100 according to the present embodiment has a resonance frequency determined by the capacitance (C1+C2) and the inductance (L1+L2+L3+L4+L5+L6). When an electromagnetic wave having this resonance frequency is incident, the magnetic permeability resonance occurs.

In the multilayer capacitor, the capacitance is generated respectively between the neighboring internal electrodes. However, the influences on formation of the resonance circuit of the capacitances other than the capacitance of the uppermost layer and the capacitance of the lowermost layer are small. This is because current is concentrated in the outermost layers of the circulating path which cause resonance.

Figure 4:
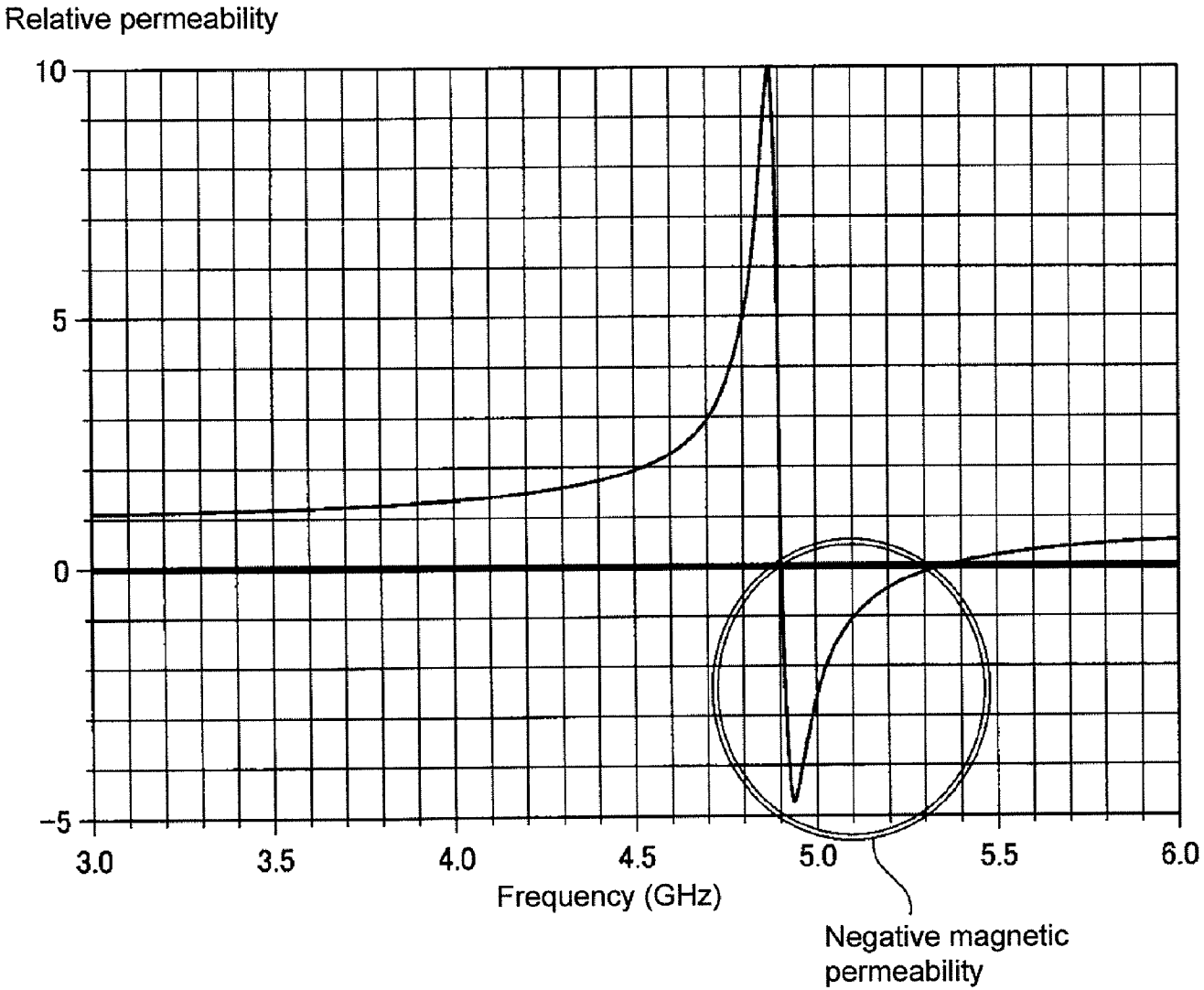
FIG. 4 is a diagram showing an example of frequency characteristics of relative permeability generated in the resonator-built-in substrate according to the first embodiment of the present invention.

FIG. 4 is a diagram showing an example of frequency characteristics of relative permeability generated in the resonator-built-in substrate 110 according to the first embodiment of the present invention. A change characteristic shown in FIG. 4 is calculated by simulation. The relative permeability indicates the ratio of magnetic permeability to magnetic permeability in vacuum.

With reference to FIG. 4, it is understood that the resonator-built-in substrate 110 according to the present embodiment has about 4.9 GHz as one of resonance frequencies and the relative permeability largely fluctuates around thereof. Accordingly, the impedance also largely fluctuates, to cause a mismatch, and the resonator-built-in substrate 110 functions as a band block filter for the current flowing in the conductor 14 in the frequency range.

In the above description, when the respective electrode planes of the first and second internal electrodes 4 and 5 and the first and second external electrodes 2 and 3 are disposed so as to be substantially parallel to the line of magnetic force of the magnetic field, the negative magnetic permeability as a function of a metamaterial can appear. "Substantially parallel" is an expression excluding a state where the respective electrode planes are orthogonal to the line of magnetic force of the magnetic field, and includes not only a state where each of the electrode planes is quite parallel to the line of magnetic force of the magnetic field but also a state where each of the electrode planes has a predetermined angle with respect to the line of magnetic force. In practice, when the negative magnetic permeability which appears in the resonator 100 has a value satisfying requirements of an applied application and the like, the electrode planes can be regarded as "substantially parallel".

Figure 5:
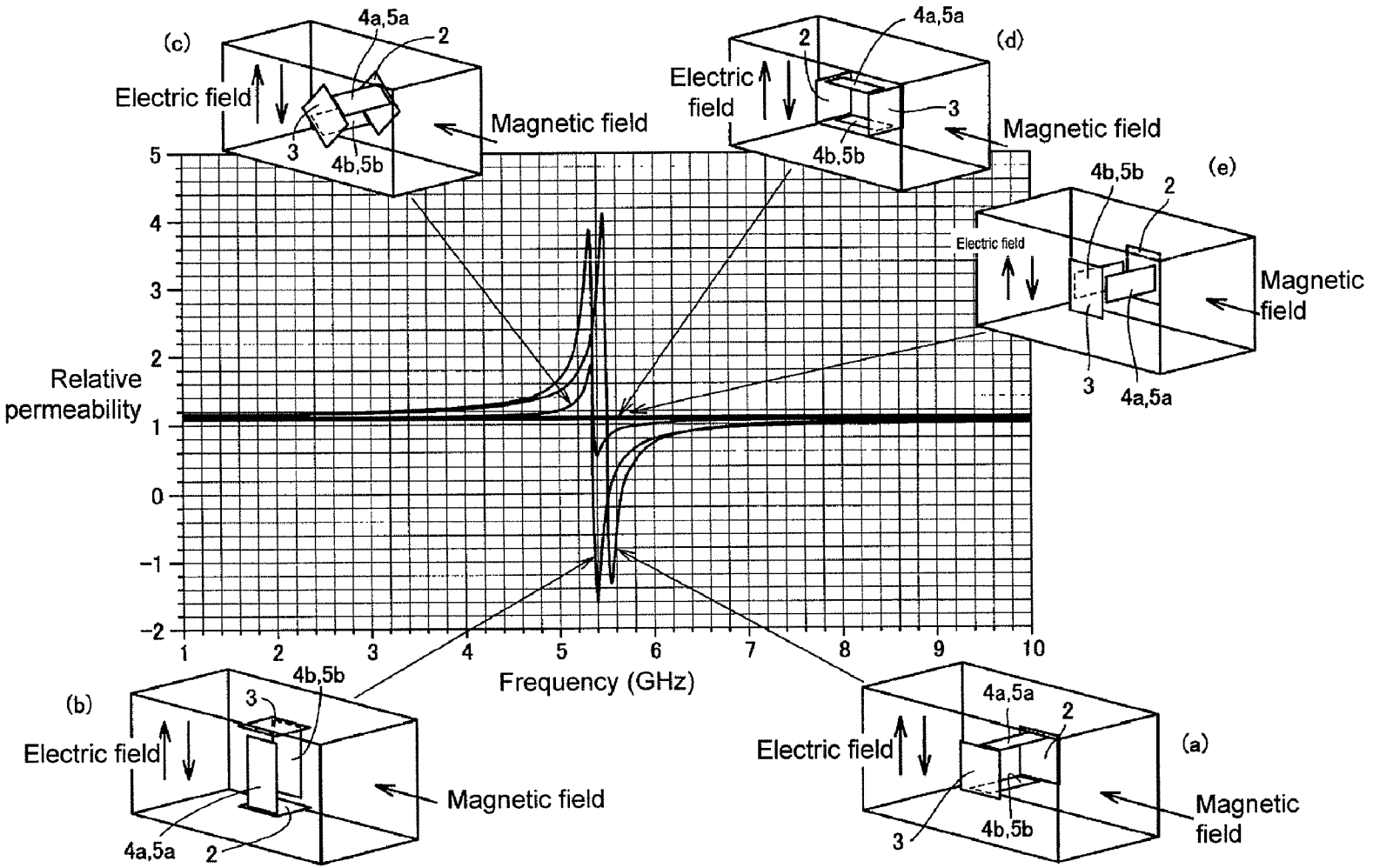
FIG. 5 is a diagram showing results of simulations by orientations of a multilayer capacitor, of frequency characteristics of the relative permeability generated in the resonator according to the first embodiment of the present invention.

FIG. 5 is a diagram showing results of simulations by orientations of a multilayer capacitor, on frequency characteristics of the relative permeability generated in the resonator 100 according to the first embodiment of the present invention.

With reference to FIG. 5, dispositions (a) and (b) show the cases where the respective electrode planes of the first and second internal electrodes 4 and 5 and the first and second external electrodes 2 and 3 are disposed parallel to the line of magnetic force of the magnetic field. A disposition (c) shows the case where the respective electrode planes of the first and second internal electrodes 4 and 5 are disposed at an angle of 45° with respect to the line of magnetic force of the magnetic field. A disposition (d) shows the case where the respective electrode planes of the first and second external electrodes 2 and 3 are disposed orthogonal to the line of magnetic force of the magnetic field. A disposition (e) shows the case where the respective electrode planes of the first and second internal electrodes 4 and 5 are disposed orthogonal to the line of magnetic force of the magnetic field.

In the dispositions (a) and (b), it is understood that, although the resonance frequencies are slightly different, sufficiently large negative magnetic permeability appears as the frequency characteristic of the relative permeability shows. In the disposition (c), it is understood that, although the negative magnetic permeability appears, the negative magnetic permeability is smaller than those appearing in the dispositions (a) and (b).

On the other hand, in the dispositions (d) and (e), as indicated by the frequency characteristic of the relative permeability, no resonance occurs, and no negative magnetic permeability appears.

It is understood that, as described above, in the case where the electrode plane of any one of the first and second internal electrodes 4 and 5 and the first and second external electrodes 2 and 3 is disposed orthogonal to the line of magnetic force of the magnetic field, no negative magnetic permeability appears. In other dispositions, even when the electrode planes are not perfectly parallel to the line of magnetic force of the magnetic field, negative magnetic permeability appears.

Although the configuration of the resonator-built-in substrate 110 in which the positional relation between the conductor 14 and the resonator 100 is preset has been described above as an example, negative magnetic permeability may be made appear by disposing the resonator 100 in a predetermined position with respect to the conductor 14.

As the procedure in this case, first, the respective electrode planes of the first and second internal electrodes 4 and 5 are disposed so as to be substantially parallel to the line of magnetic force which is generated in the case where current flows in the conductor 14. Concretely, the upper and lower electrode planes of the resonator 100 are disposed so as to be parallel to the extension direction of the conductor 14. Next, the respective electrode planes of the first and second external electrodes 2 and 3 are disposed so as to be substantially parallel to the line of magnetic force which is generated in the case where current flows in the conductor 14. Concretely, the orientation of the resonator 100 is adjusted so that the external electrode planes of the resonator 100 match the plane perpendicular to the extension direction of the conductor 14. By disposing the resonator 100 in accordance with such procedures, negative magnetic permeability can be made appear.

The order of the above-described two procedures may be reversed.

Referring again to FIGS. 1 to 3, the configuration of the resonator 100 according to the present embodiment can be also expressed as follows.

The resonator 100 includes: a pair of external electrode made of the first and second external electrodes 2 and 3; a plurality of first internal electrodes 4 electrically connected to the first external electrode 2 as one of the pair of external electrodes; and a plurality of second internal electrodes 5 electrically connected to the second external electrode 3 as the other one of the pair of eternal electrodes. Each of the electrode planes of the internal electrode group made of the first and second internal electrodes 4 and 5 is formed so as to be perpendicular to the electrode planes of the first and second external electrodes 2 and 3. Each of the electrode planes of the first and second external electrodes 2 and 3 is formed so as to match a plane perpendicular to a propagation direction of current flowing in the conductor 14. Further, there is formed an electric circulating path including the capacitance (C1) generated between the electrode 4*a* in the uppermost layer of the first internal electrode and the electrode 5*a* in the uppermost layer of the second internal electrode adjacent to the electrode 4*a*, the capacitance (C2) generated between the electrode 4*b* in the lowermost layer of the first internal electrode and the electrode 5*b* in the lowermost layer of the second internal electrode adjacent to the electrode 4*b*, and the first and second external electrodes 2 and 3.

The resonator 100 includes the first and second internal electrodes 4 and 5 as a plurality of flat-plate electrodes disposed parallel to each other via the spacer 6 as an insulator; the first external electrode 2 as a first connection electrode electrically connected to an even-numbered first internal electrode 4 in the plurality of flat-plate electrodes; and the second external electrode 3 as a second connection electrode electrically connected to an odd-numbered second internal electrode 5 in the plurality of flat-plate electrodes. The respective electrode planes of the first and second external electrodes 2 and 3 are formed perpendicular to electrode planes of the plurality of flat-plate electrodes. The electrode planes of the plurality of flat-plate electrodes are disposed substantially parallel to the line of magnetic force generated when current flows in the conductor 14.

The resonator 100 includes a first comb-shaped electrode made by pluralities of first internal electrodes 4 and first external electrodes 2 parallel to one other, and a second comb-shaped electrode made by pluralities of second internal electrodes 5 and second external electrodes 3 parallel to one another. The electrode plane of the electrode 4*a* in the uppermost layer of the first comb-shaped electrode and that of the electrode 5*a* in the uppermost layer of the second comb-shaped electrode are formed so as to face each other in parallel at a predetermined interval. With this configuration, capacitance (C1) is formed therebetween. The electrode plane of the electrode 4*b* in the lowermost layer of the first comb-shaped electrode and that of the electrode 5*b* in the lowermost layer of the second comb-shaped electrode are formed so as to face each other in parallel at a predetermined interval. With this configuration, capacitance (C2) is formed therebetween. The respective electrode planes of the first and second comb-shaped electrodes are disposed so as to be substantially parallel to the line of magnetic force which is generated when current flows in the conductor 14.

According to the first embodiment of the present invention, used is the resonance circuit made mainly by capacitance generated between the stacked electrodes, so that capacitance included in the resonance circuit can be made relatively large. Consequently, as compared with the configuration of periodically disposing ring patterns as in the split ring resonator, the device size for obtaining necessary resonance characteristics can be made smaller. Thus, with the miniaturized device, negative dielectric constant can be realized.

According to the first embodiment of the present invention, by using a commercially available multilayer capacitor, the resonator can be constructed. Therefore, negative dielectric constant can be realized more easily.

SECOND EMBODIMENT

Although one resonator has been described above in the first embodiment, to obtain a larger effect, it is preferable to use a plurality of resonators. In a second embodiment of the present invention, a substrate constructed by a plurality of resonators will be described.

Figure 6:
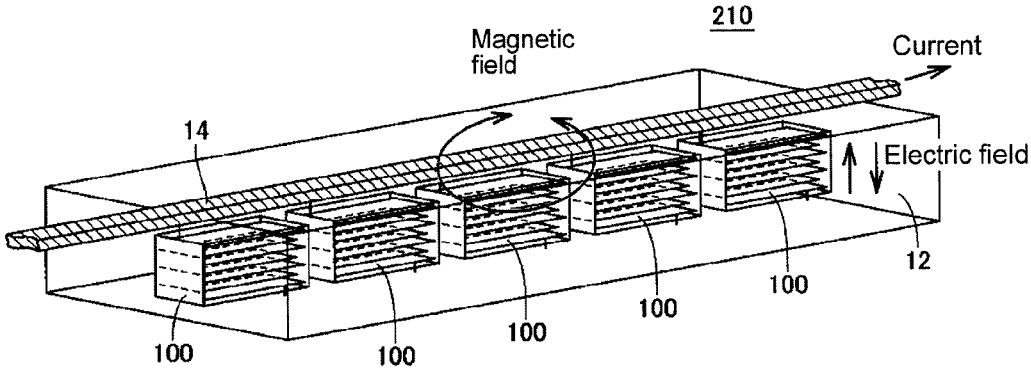
FIG. 6 is a schematic external view of a resonator-built-in substrate according to a second embodiment of the present invention.

FIG. 6 is a schematic external view of a resonator-built-in substrate 210 according to the second embodiment of the present invention.

With reference to FIG. 6, the resonator-built-in substrate 210 is obtained by periodically disposing a plurality of (five in FIG. 6) resonators 100 described above along the conductor 14. The respective electrode planes of the first internal electrodes 4 (FIG. 2) and the second internal electrodes 5 (FIG. 2) constructing each of the resonators 100 are disposed substantially parallel to the line of magnetic force of magnetic field. The respective electrode planes of the first external electrode 2 (FIG. 2) and the second external electrode 3 (FIG. 2) are also disposed substantially parallel to the line of magnetic field.

Since the configuration of each of the resonators 100 is similar to that of the foregoing first embodiment, detailed description thereof will not be repeated.

Figure 7:
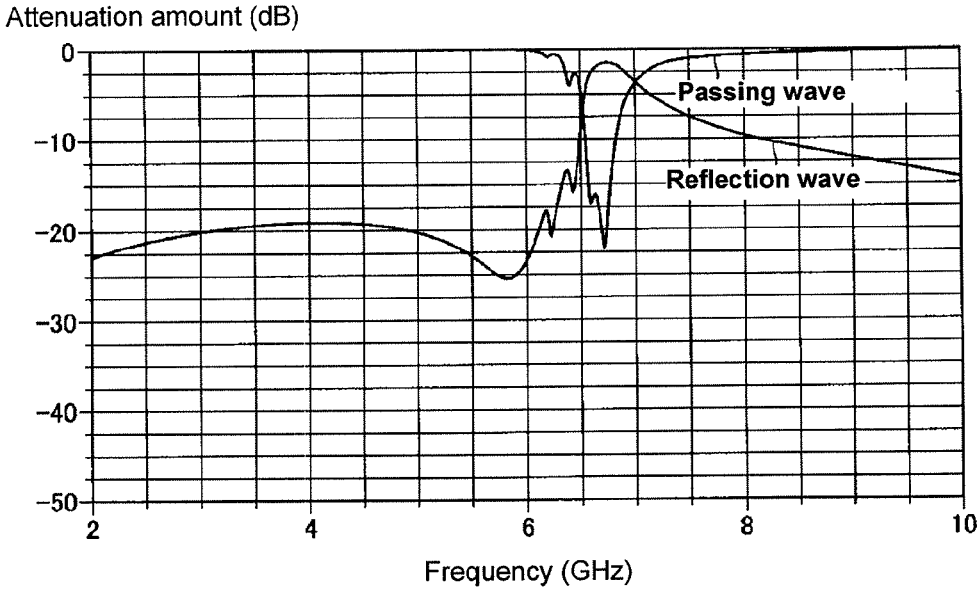
FIG. 7 is a diagram showing an example of frequency characteristics of an attenuation amount of current flowing in a conductor in the resonator-built-in substrate according to the second embodiment of the present invention.

FIG. 7 is a diagram showing an example of frequency characteristics of an attenuation amount of current flowing in the conductor 14 in the resonator-built-in substrate 210 according to the second embodiment of the present invention. A change characteristic shown in FIG. 7 is calculated by simulation.

With reference to FIG. 7, it is understood that the resonator-built-in substrate 210 according to the present embodiment has a resonance point around 6.5 GHz to 7.0 GHz, and a passing wave is largely attenuated in the frequency region thereof.

According to the second embodiment of the present invention, resonators of the number necessary for required characteristics (representatively, a necessary attenuation amount) can be disposed. Thus, a substrate realizing an optimum negative dielectric constant can be easily constructed in accordance with an application to be applied.

THIRD EMBODIMENT

Although the configuration of the multilayer capacitor in which the width of the internal electrode and that of the external electrode in the connection plane are equal to each other has been described in the above first embodiment, to increase inductance generated in the external electrode, the width of the external electrode may be further narrowed.

Figure 8:
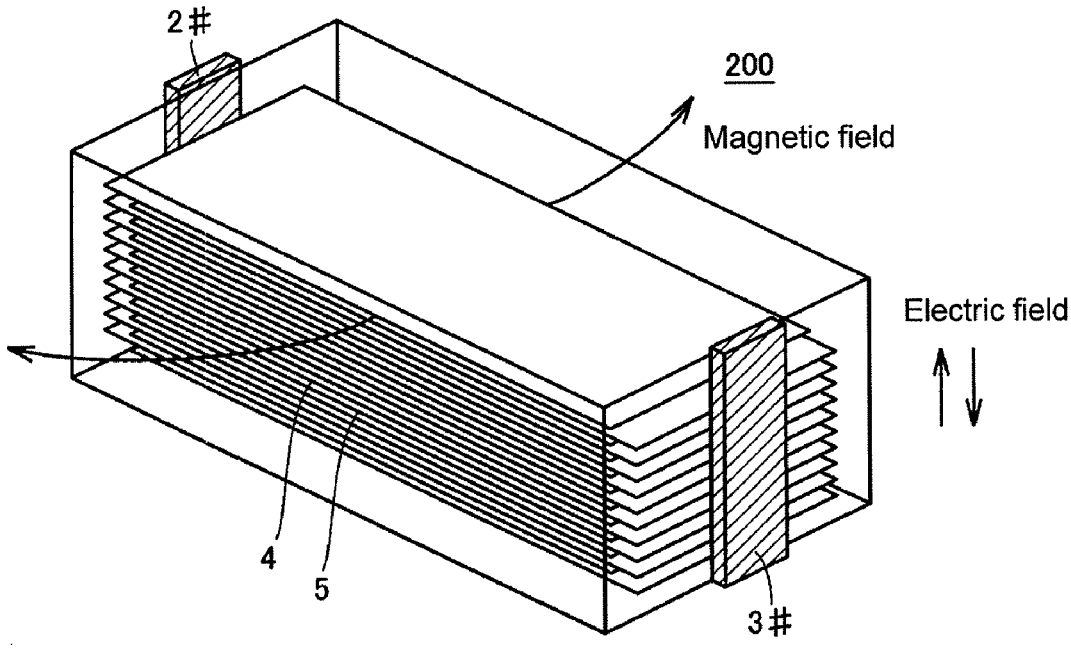
FIG. 8 is a schematic external view of a resonator according to a third embodiment of the present invention.

FIG. 8 is a schematic external view of a resonator 200 according to a third embodiment of the present invention.

With reference to FIG. 8, the resonator 200 according to the present embodiment includes: a plurality of first internal electrodes 4 and a plurality of second internal electrodes 5 disposed so as to face each other alternately via spacers; a first external electrode 2# electrically connected to each of the first internal electrodes 4; and a second external electrode 3# electrically connected to each of the second internal electrodes 5.

In the connection plane between the first internal electrode 4 and the first external electrode 2#, the width of the first external electrode 2# is smaller than that of the first internal electrode 4. In the connection plane between the second internal electrode 5 and the second external electrode 3#, the width of the second external electrode 3# is smaller than that of the second internal electrode 5.

By narrowing the line width of each of the first and second external electrodes 2# and 3#, the inductance generated in the first and second external electrodes 2# and 3# can be increased. Consequently, in the resonance circuit as shown in FIG. 3, the capacitance (C1+C2) necessary to generate the same resonance frequency can be made small. Thus, the internal electrode can be made smaller and, as a result, the entire multilayer capacitor can be miniaturized.

The other configuration is similar to that of the foregoing first embodiment, so that detailed description thereof will not be repeated.

According to the third embodiment of the present invention, effects similar to those of the first embodiment can be obtained and, in addition, the size can be made smaller than that of the resonator according to the first embodiment.

FOURTH EMBODIMENT

Although the resonators 100 are periodically disposed in line along the conductor 14 in the second embodiment described above, a plurality of resonators 100 may be disposed in a plurality of lines or plurality of stages.

Figure 9A:
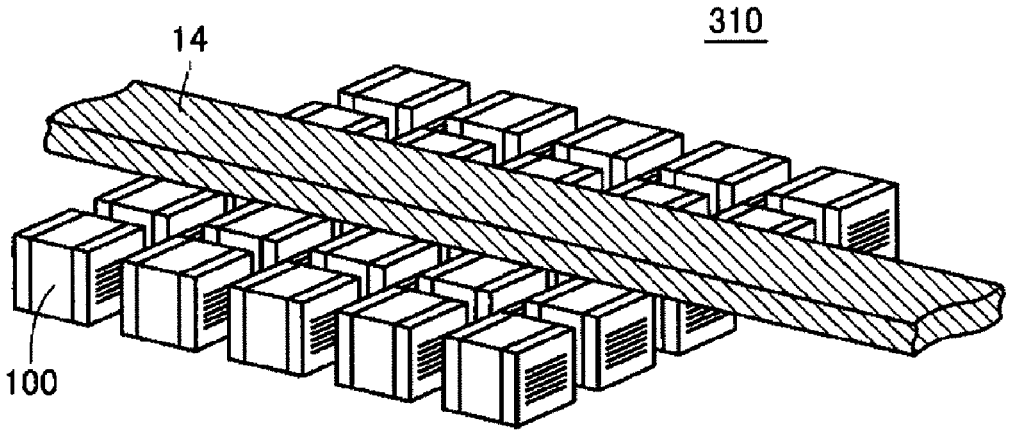
FIGS. 9(*a*) and 9(*b*) are schematic external views of a substrate according to a fourth embodiment of the present invention.
Figure 9B:
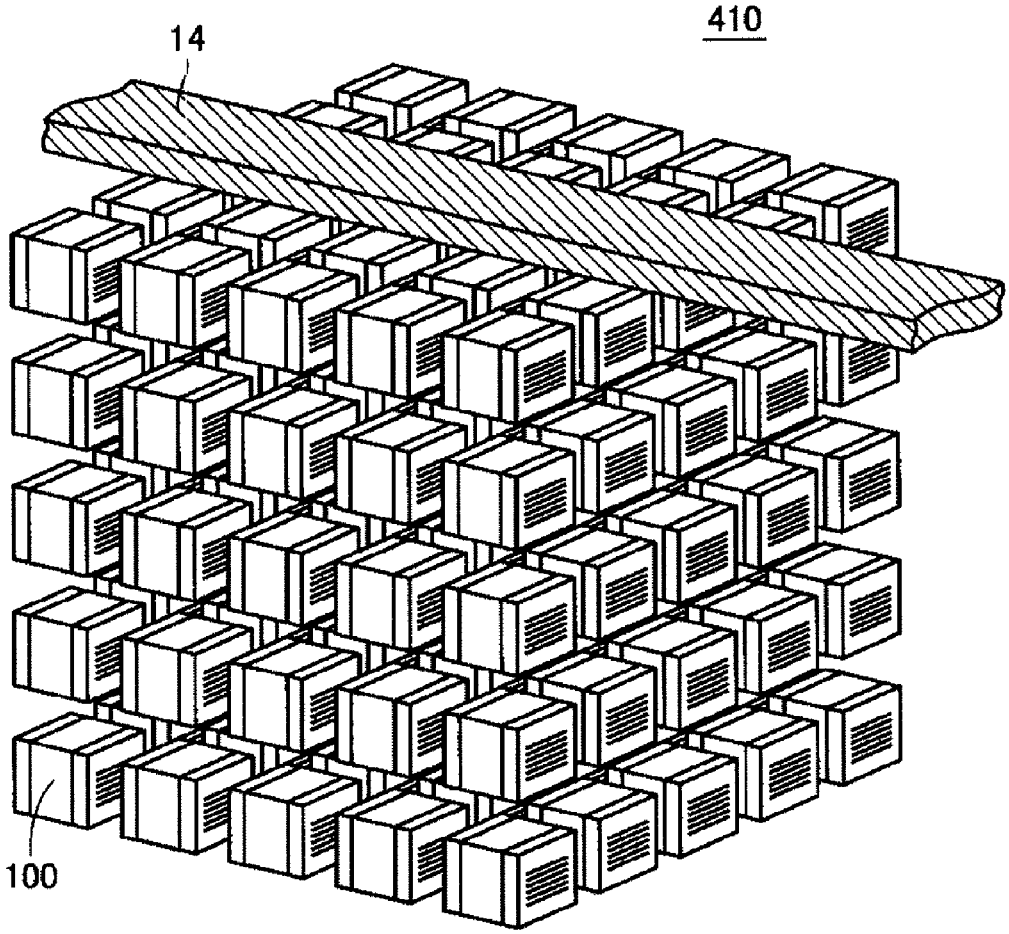
Figure 10:
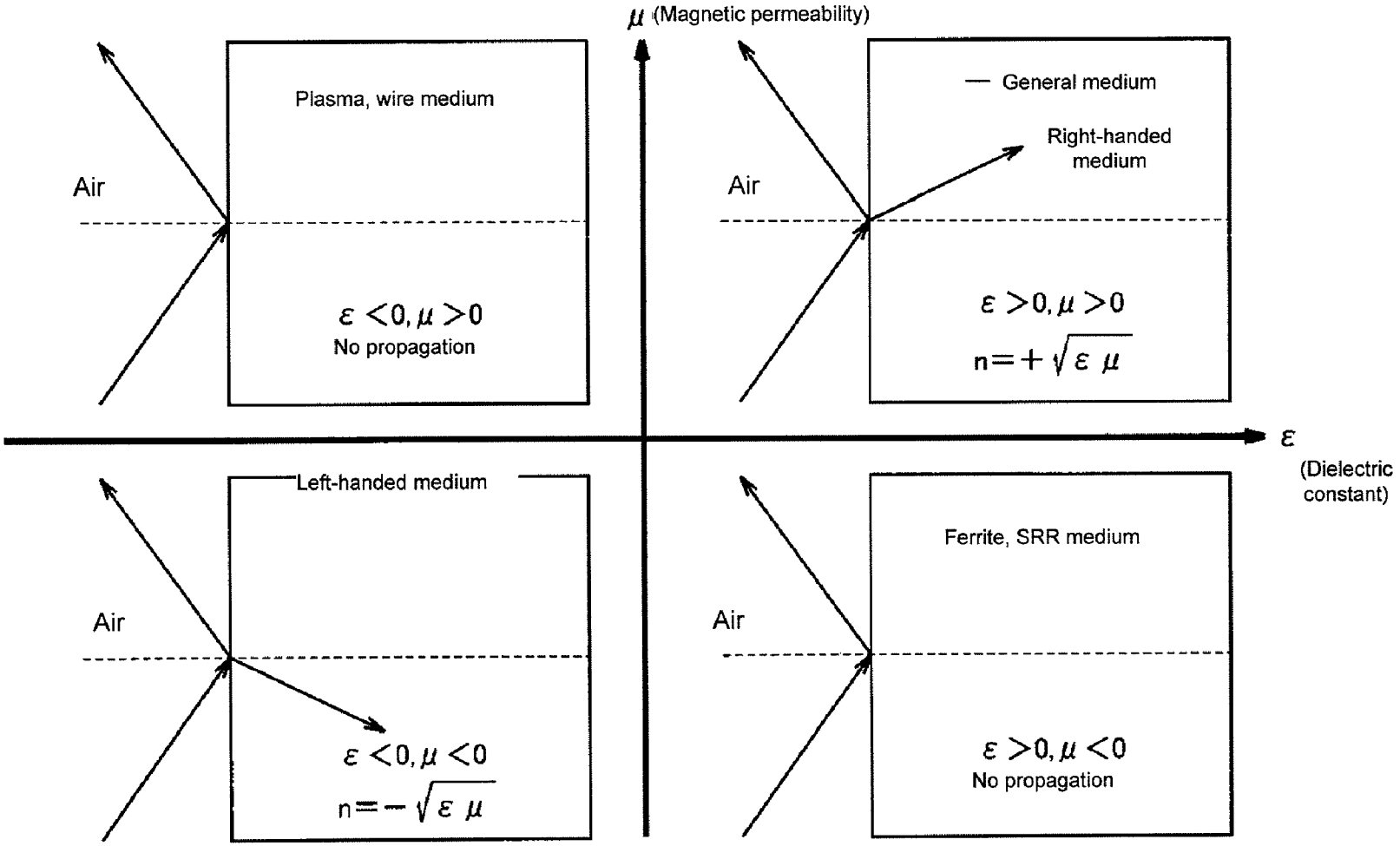
FIG. 10 is a four-quadrant diagram showing characteristics appearing with respect to waves incident on a medium by signs of the magnetic permeability μ and the dielectric constant ∈.

FIG. 9(*a*) is a schematic external view of a substrate 310 according to the fourth embodiment of the present invention. FIG. 9(*b*) is a schematic external view of a substrate 410 according to another mode of the fourth embodiment of the present invention.

With reference to FIG. 9(*a*), the substrate 310 is obtained by periodically two-dimensionally disposing the plurality of resonators 100 described above with the conductor 14 as a center. With reference to FIG. 9(*b*), the substrate 410 is obtained by periodically three-dimensionally disposing the plurality of resonators 100 described above with the conductor 14 as a center.

Also in the substrates 310 and 410, the respective electrode planes (FIG. 2) of the first and second internal electrodes 4 and 5 constructing each of the resonators 100 are disposed substantially parallel to the line of magnetic force of the magnetic field. The respective electrode planes (FIG. 2) of the first and second external electrodes 2 and 3 are also disposed substantially parallel to the line of magnetic force of the magnetic field. In FIGS. 9(*a*) and 9(*b*), the internal electrodes are intentionally shown for easier understanding.

By attaching this substrate 310 or 410 to, for example, an electronic device which generates electromagnetic waves of high frequencies or an electronic device which is easily influenced by disturbance noise, the substrate can be made function as an electromagnetic shield.

According to the fourth embodiment of the present invention, even in a case where an electromagnetic wave generation source is disposed in a shape other than a straight line, by disposing resonators in an arbitrary shape, electromagnetic waves can be properly absorbed or suppressed.

OTHER EMBODIMENTS

Although the configuration for making negative dielectric constant appear by using a general multilayer capacitor has been exemplified in each of the first to fourth embodiments, there may be used an electrode member designed dedicatedly to construct the resonator or the substrate according to the present invention.

It should be understood that the embodiments disclosed herein are illustrative and not restrictive in all respects. The scope of the present invention is defined by the scope of claims rather than by the above description, and all the changes that fall within meets and bounds of the claims or equivalence are intended to be included.

The invention claimed is:

1. A resonator disposed adjacent to a conductor in which current including a predetermined frequency component flows to generate resonance in response to a magnetic flux of an electromagnetic wave generated by the current, the resonator comprising:

a plurality of pairs of electrodes each including first and second electrodes facing each other with an insulator disposed therebetween;

a third electrode electrically connected to each of the first electrodes; and a fourth electrode electrically connected to each of the second electrodes, wherein the resonator is disposed so that respective electrode planes of the first and second electrodes are substantially parallel to a line of magnetic force which is generated when the current flows in the conductor, respective electrode planes of the third and fourth electrodes are substantially parallel to the line of magnetic force in planes different from the respective electrode planes of the first and second electrodes, and the resonator is not electrically connected to the conductor or to a ground electrode in a floated state.

2. The resonator according to claim 1, wherein a length of the resonator along the conductor is shorter than ¼ of one wavelength corresponding to the predetermined frequency component.

3. A substrate comprising:

a plurality of resonators each having features identical to the resonator according to claim 1 disposed periodically along the conductor.

4. A resonator disposed adjacent to a conductor in which current including a predetermined frequency component flows to generate resonance in response to a magnetic flux of an electromagnetic wave generated by the current, the resonator comprising:

a pair of opposed electrodes positioned so as to face each other; and an electrode group located between the pair of electrodes, the electrode group including a plurality of first electrodes electrically connected to a first of the pair of opposed electrodes and a plurality of second electrodes electrically connected to a second of the pair of opposed electrodes, wherein the electrode group includes a plurality of electrode planes each of the plurality of electrode planes of the electrode group is perpendicular to corresponding electrode planes of the opposed electrodes, each corresponding electrode plane of the pair of opposed electrodes is parallel to a plane perpendicular to a propagation direction of the current flowing in the conductor, and the resonator is not electrically connected to the conductor or to a ground electrode in a floated state.

5. The resonator according to claim 4, wherein the pair of opposed electrodes are parallel to each other.

6. The resonator according to claim 4, wherein the resonator forms an electric circulating path that has a first capacitance between one of the first electrodes and a second electrode adjacent to the one of the first electrodes, a second capacitance between another one of the first electrodes and a third electrode adjacent to the another one of the first electrodes, and the pair of opposed electrodes.

7. The resonator according to claim 4, wherein a length of the resonator along the conductor is shorter than ¼ of one wavelength corresponding to the predetermined frequency component.

8. The resonator according to claim 4, wherein in a connection plane between each of the electrodes of the electrode group and the pair of electrodes, a width of the pair of electrodes is smaller than a width of each of the electrodes of the electrode group.

9. A substrate comprising:

a plurality of resonators each having features identical to the resonator according to claim 5 disposed periodically along the conductor.

10. A resonator disposed adjacent to a conductor in which current including a predetermined frequency component flows to generate resonance in response to a magnetic flux of an electromagnetic wave generated by the current, the resonator comprising:

a plurality of flat-plate electrodes disposed parallel to each other with an insulator disposed therebetween;

a first connection electrode electrically connected to an even-numbered flat-plate electrode of the plurality of flat-plate electrodes; and a second connection electrode electrically connected to an odd-numbered flat-plate electrode of the plurality of flat-plate electrodes, wherein respective electrode planes of the first and second connection electrodes are perpendicular to electrode planes of the plurality of flat-plate electrodes, respective ones of said electrode planes of the plurality of flat-plate electrodes are disposed substantially parallel to a line of magnetic force generated when the current flows in the conductor, and the resonator is not electrically connected to the conductor or to a ground electrode in a floated state.

11. The resonator according to claim 10, wherein a strip-shaped conductor serves as the conductor is disposed in a position apart by a predetermined distance from an uppermost plane of the plurality of flat-plate electrodes, and a ground electrode is further provided in a position apart by a predetermined distance from a lowest plane of the plurality of flat-plate electrodes.

12. The resonator according to claim 10, wherein a length of the resonator along the conductor is shorter than ¼ of one wavelength corresponding to the predetermined frequency component.

13. A substrate comprising:

a plurality of resonators each having features identical to the resonator according to claim 12 disposed periodically along the conductor.

14. A resonator disposed adjacent to a conductor in which current including a predetermined frequency component flows to generate resonance in response to a magnetic flux of an electromagnetic wave generated by the current, the resonator comprising:

first and second comb-shaped electrodes parallel to one another, wherein a first electrode plane of the first comb-shaped electrode and a first electrode plane of the second comb-shaped electrode face each other in parallel at a first predetermined interval and a second electrode plane of the first comb-shaped electrode and a second electrode plane of the second comb-shaped electrode face each other in parallel at a second predetermined interval, respective ones of said electrode planes of the first and second comb-shaped electrodes are disposed substantially parallel to a line of magnetic force generated when the current flows in the conductor, and the resonator is not electrically connected to the conductor or to a ground electrode in a floated state.

15. The resonator according to claim 14, wherein a length of the resonator along the conductor is shorter than ¼ of one wavelength corresponding to the predetermined frequency component.

16. A substrate comprising:

a plurality of resonators each having features identical to the resonator according to claim 14 disposed periodically along the conductor.

17. A method of generating resonance with a predetermined frequency component in a current flowing in a conductor, the method comprising:

disposing a resonator adjacent to the conductor such that the resonator is not electrically connected to the conductor or to a ground electrode in a floated state, wherein the resonator includes a plurality of pairs of electrodes each having first and second electrodes facing each other with an insulator therebetween; a third electrode electrically connected to each of the first electrodes; and a fourth electrode electrically connected to each of the second electrodes;

disposing respective electrode planes of the first and second electrodes so as to be substantially parallel to a line of magnetic force which is generated when the current flows in the conductor; and disposing respective electrode planes of the third and fourth electrodes so as to be substantially parallel to the line of magnetic force in planes different from the respective electrode planes of the first and second electrodes.

* * * * *